US005596827A

United States Patent [19]

Boulos

[11] Patent Number: 5,596,827

[45] Date of Patent: Jan. 28, 1997

[54] DEVICE FOR MAKING A LIQUID APPEAR TO RISE UP A TUBE

[76] Inventor: Daniel M. Boulos, 3707 Rolling Hills Ave. #B-2, Alexandria, Va. 22309

[21] Appl. No.: 519,810

[22] Filed: Aug. 25, 1995

[51] Int. Cl.[6] ..... G09F 19/00

[52] U.S. Cl. ..... 40/406; 472/67

[58] Field of Search ..... 446/14, 267; 472/67, 472/52; 40/406, 435; 434/126

[56] References Cited

U.S. PATENT DOCUMENTS

| | | | |
|---|---|---|---|
| 1,503,546 | 8/1924 | Menzies . | |
| 1,856,098 | 5/1932 | Green | 40/406 |
| 2,182,570 | 12/1939 | Rosenblatt | 40/406 |
| 2,278,383 | 3/1942 | Rosenblatt | 40/406 |
| 2,378,934 | 6/1945 | Kloner | 40/406 |
| 2,383,941 | 9/1945 | Otis | 40/406 |
| 2,412,171 | 12/1946 | Petry | 40/406 |
| 2,453,177 | 11/1948 | Abramson | 40/406 |
| 3,499,238 | 3/1970 | Publicker | 40/406 |
| 4,989,124 | 1/1991 | Shappell | 40/435 X |

FOREIGN PATENT DOCUMENTS

| | | | |
|---|---|---|---|
| 1229799 | 5/1986 | U.S.S.R. | 446/267 |
| 666061 | 2/1952 | United Kingdom | 446/14 |

*Primary Examiner*—Joanne Silbermann
*Attorney, Agent, or Firm*—Patentec

[57] ABSTRACT

A bubble device for simulating the flow of liquid through a transparent tube, the device including an upper reservoir, a lower reservoir, a bubble generation section, a bubble refining section and an interconnecting transparent tube containing a volatile liquid therein. When the lower reservoir is heated and the upper reservoir is cooled, the volatile liquid is driven from the lower reservoir by the presence of heated vapor of the volatile liquid. Eventually, the heated vapor expands to the bubble generation section whereby bubbles are generated and caused to pass through the bubble refining section to break up the bubbles into smaller bubbles which travel upward through the transparent tube. A control circuit is used to maintain a constant temperature differential between the upper and lower reservoirs in order to ensure the proper and continued operation of the device.

44 Claims, 4 Drawing Sheets

102
412
412
(−)
206
(+)
203
404
207
411
410
409
410
409
408
405

416
416
(-)
(+)
415
414
413

DEVICE FOR MAKING A LIQUID APPEAR TO RISE UP A TUBE

FIELD OF THE INVENTION

The present invention relates to a device which provides the illusion that a liquid is constantly moving up a tube, utilizing the principle of differential temperature and pressure applied to a volatile liquid.

BACKGROUND OF THE INVENTION

Advertising and other display devices utilizing differential temperature and pressure to cause vapor bubbles of a volatile liquid to move up a tube are known. For example, U.S. Pat. No. 1,503,564 to Menzies consists of a transparent tube connecting two reservoirs containing a volatile liquid. The apparatus uses the temperature differential caused by external heating of one side of the device to cause the expansion of the volatile liquid vapor resulting in an increase of internal pressure. This increased pressure causes the vapor of the volatile liquid to rise through the transparent tube to the upper reservoir where it is cooled by the evaporation of liquid absorbed by a wick dipping in water of a receptacle. This cooling then causes the condensation of the vapor into liquid, whereupon gravity pulls the liquid down the tube. However, this device lacks a reliable method far generating and controlling the rate of cooling and heating, and requires a low humidity in the ambient air to operate.

U.S. Pat. No. 2,453,177 to Abramson is an example of devices that utilize an active heat source to boil a volatile liquid and cause bubbling. In this patent, heat is provided by an electric light bulb placed in proximity to the volatile. liquid. The bubbles rise to the top of the device where the vapor cools and becomes condensed upon exposure to atmospheric air (the temperature of which is lower than the boiling point of the liquid in the lower part of the device).

The Abramson device also lacks a controlled mechanism to regulate the heating and cooling of the liquid. For example, this device could explode if the heat provided by the light bulb is too great. It also is concerned only with the creation of bubbles, and is not directed toward an apparatus that gives the illusion that the liquid is rising through a tube.

SUMMARY OF THE INVENTION

Therefore, the present invention relates to a device capable of giving the appearance that a liquid is rising up a tube. In its preferred embodiments, the invention provides a controlled and safe means for maintaining the temperature differential between two reservoirs so that the proper transfer of the volatile liquid and vapor bubbles thereof may occur. The invention also provides means to enable the vapor bubbles to be broken into smaller bubbles to further enhance the visual appearance.

In a preferred embodiment, the invention comprises a device including a tube terminated with two reservoirs. Air is evacuated from the device and the upper and lower reservoirs have thermoelectric modules for cooling and heating the volatile liquid and its vapor. In addition, the lower reservoir is connected to a bubble refining area where large bubbles are converted to smaller bubbles. This bubble refining area is then connected to the upper reservoir via a transparent tube containing a loose bundle of transparent capillary tubes. Sensors are provided to monitor the temperature of the upper and lower reservoirs, and control circuitry regulates the current provided to the thermoelectric modules to maintain a desired differential temperature.

DETAILED DESCRIPTION

Figure 1:
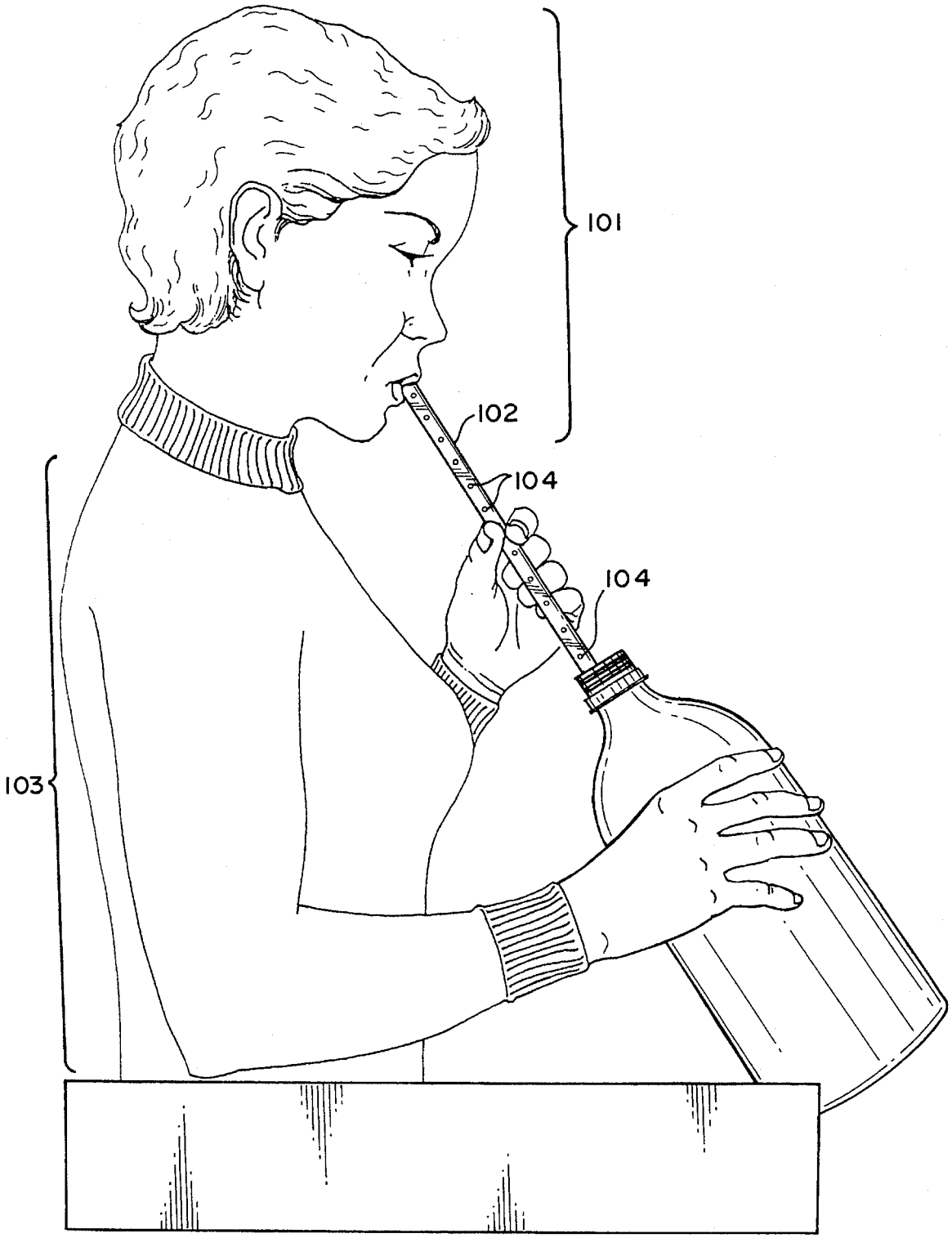
FIG. 1 shows an overview of an embodiment of the present invention.
Figure 2:
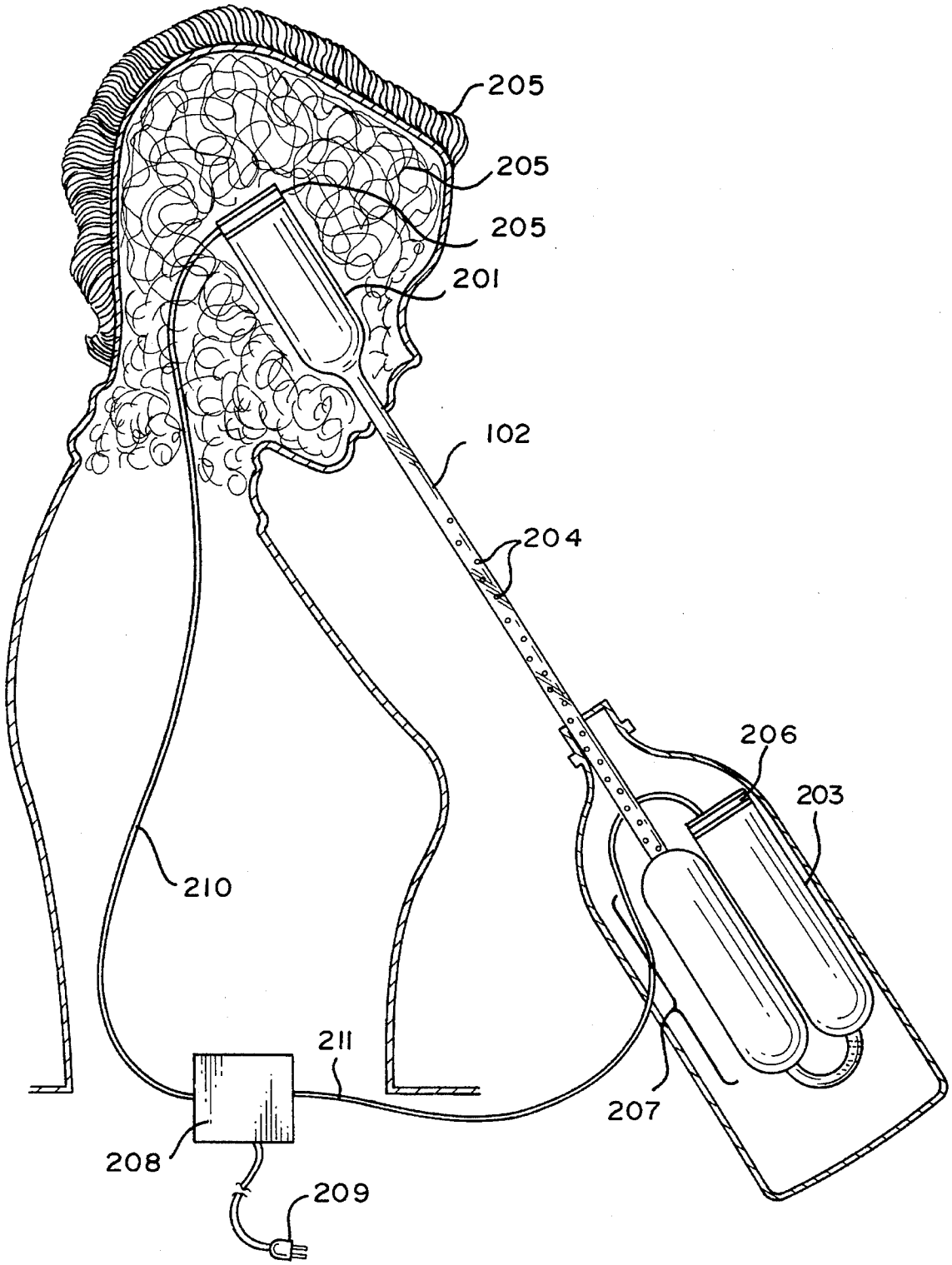
FIG. 2 shows schematically a more detailed overview of the present invention.

FIG. 1 shows a device in the form of a statuette having upper region 101, transparent tube 102 and lower region 103. The particular overall form illustrated in FIG. 1 is for illustrative purposes only; the display device can be formed in any suitable shape desired for the particular display application. The transparent tube is filled with a liquid, which may be colored or carry suspended particles to give an enhanced visual appearance. The liquid contains at least one volatile component capable of vaporization at a temperature somewhat above room temperature at the pressures used in the present apparatus. Suitable volatile liquids include chloroform, ether, alcohol, methyl chloride, freon™ and the like. Due to the volatility of the liquid, the arrangement of the present apparatus, and the heating and cooling means to be described below, a series of bubbles 104 may be seen traveling up the tube from the lower region to the upper region through the transparent tube, thereby giving the visual appearance of a liquid rising up the tube, FIG. 2 shows the structure of the invention in more detail. In the preferred embodiment, the statuette is substantially hollow, containing the equipment necessary to cause the display bubbles to form. The upper region 101 of the statuette contains an upper reservoir 201 connected to the transparent tube 102, and further contains reservoir cooling means 205 which will be described in more detail below. The lower region 103 comprises a lower reservoir 203, heating means 206, bubble refining means 207, control circuitry 208 and possibly a power source (i.e., battery or solar cell, not shown), or the power source may be external to the lower region through connection 209. The heating, bubble refining, and control means are described in further detail below. Control circuit 208, which may be an analog control, or a digital control including possibly a suitably programmed microprocessor, is connected to the heating and cooling means 206, 205 through cables 211 and 210, respectively, which may provide them with power and/or control functions, and may further display the operating temperature of the two reservoirs.

In basic operation, the heating means 206 is activated to heat the volatile liquid contained in the lower reservoir. As the volatile liquid is heated, the vapor pressure increases, causing the volatile liquid to be driven from the lower reservoir, and to reside in the bubble refining area 207, the transparent tube 102, and to partially fill the upper reservoir 201. Upon sufficient heating, the vapor of the volatile substance is forced up the transparent tube 102 against the liquid already contained therein, taking the form of bubbles. The purpose of the the bubble refining means 207 to be described in more detail below, is to pass the bubbles through successively smaller and smaller apertures in order to cause the bubbles to reach smaller and smaller sizes. Upon reaching the upper reservoir, the bubbles of vapor condense into liquid, which eventually flow back down the transparent tube to the lower reservoir. In order to ensure that the bubbles condense in the upper reservoir, means are provided to remove heat from the upper reservoir. In the preferred form of the invention, the heat is removed by an active cooling means 205 to be described in further detail below. The power for the active cooling means 205 and control therefor may be provided by the control circuit 208 through cable 210. The upper and lower reservoirs may be provided with temperature sensors so that the control circuit may monitor their temperatures to regulate the amount of cooling and heating. These reservoirs are preferably constructed from materials designed to enhance the thermal operation of the device. For example, the lower reservoir preferably comprises thermally insulating walls such as glass in order to retain the heat provided by the heating means. The upper reservoir preferably comprises thermally conductive walls such as copper, in order to dissipate heat.

Figure 3:
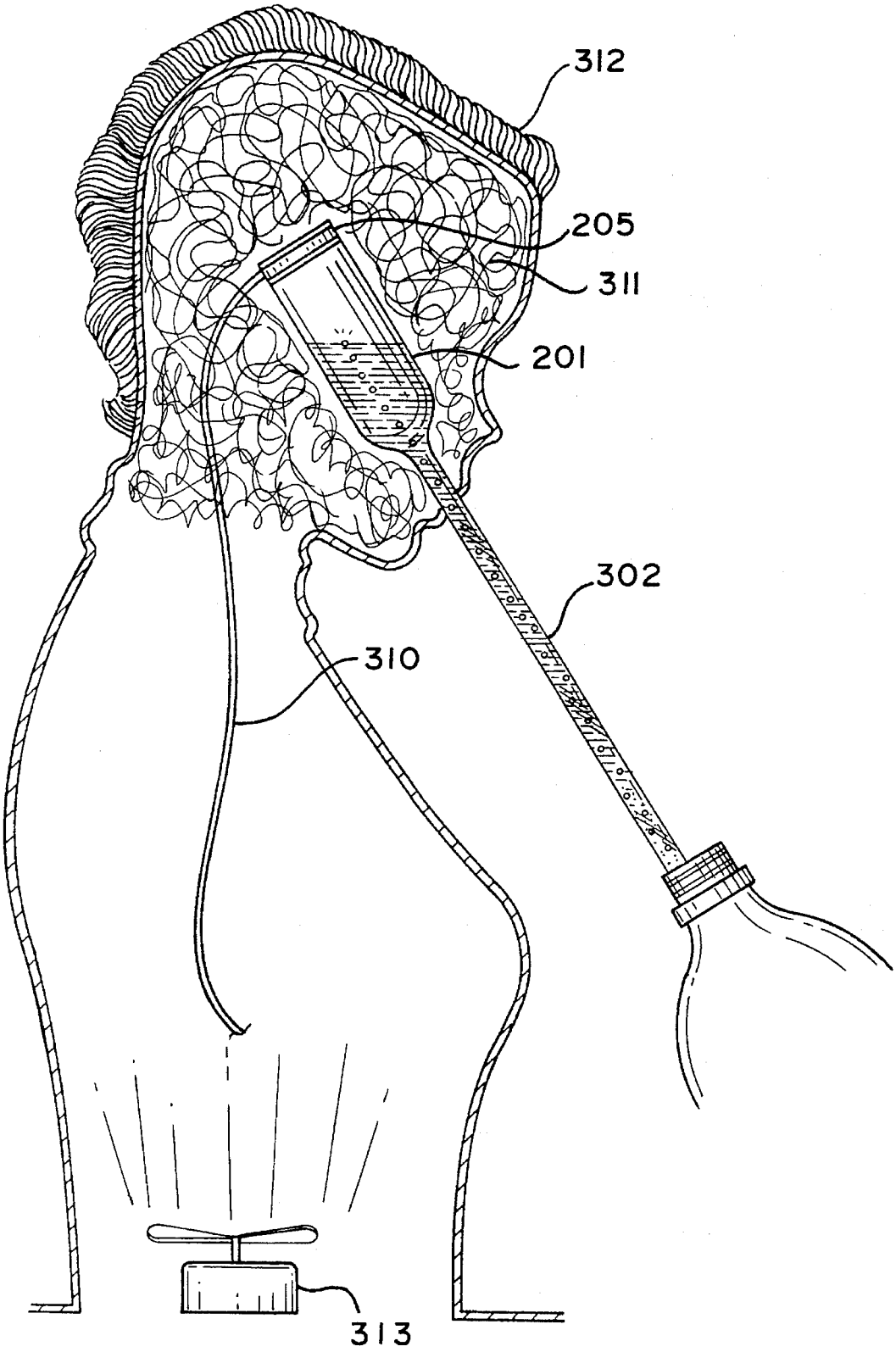
FIG. 3 shows in detail the upper reservoir and cooling means in a preferred embodiment.

FIG. 3 shows in more detail the upper reservoir and the associated cooling means in the preferred embodiment. As mentioned above, reservoir 201 preferably comprises a material highly conductive to heat, such as copper. This reservoir may also have corregated walls to strengthen the walls against pressure, and to enhance heat dissipation. In thermal contact with the upper reservoir is preferably active cooling means 205, which may be a thermoelectric cooler (i.e., Peltier device), well-known in the art. Such a device comprises a cold surface, placed in contact with the reservoir, and a hot surface including a heat sink (not shown), placed in contact with suitable heat dissipation means, such as a porous mass of steel or copper wires 311 or the like contained within the statuette housing, and/or simulated wig 312 comprising steel or copper wires or the like. (Oxidized wires are preferred because of the increased dissipation of heat in the form of infrared radiation.) The cooling means may alternatively or further comprise convective thermal transfer means, such as a cooling fan (313). The fan may be disposed at the top of the upper region, or in the base of the statuette, and may be driven to cause a flow of air through heat transfer means such as the steel or copper wires in association with the thermoelectric cooling means or so that the flow of air is in direct association with the reservoir. The cooling means may also comprise only passive means, such as the mass of wires and/or simulated wig 312 or other cooling fins (not shown), such as the corregated surface described above. Any of the active cooling devices are connected to the control circuit 208 through wires 210. The upper reservoir may also include a thermal sensor to measure the temperature of the reservoir so that the control circuit 208 will know how much power to apply to the cooling means.

Figure 4A:
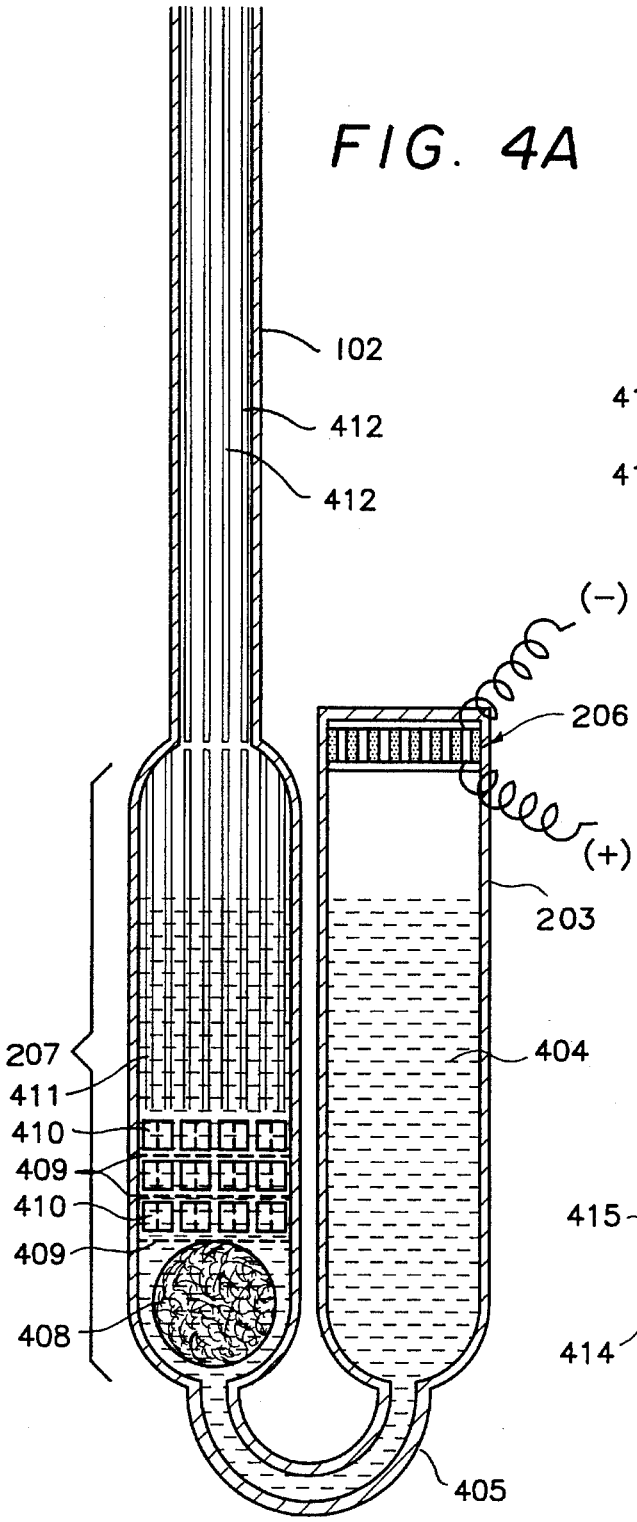
FIGS. 4A and 4B show in detail the lower reservoir and heating means before and after establishing a temperature differential between the lower and upper reservoirs in a preferred embodiment.
Figure 4B:
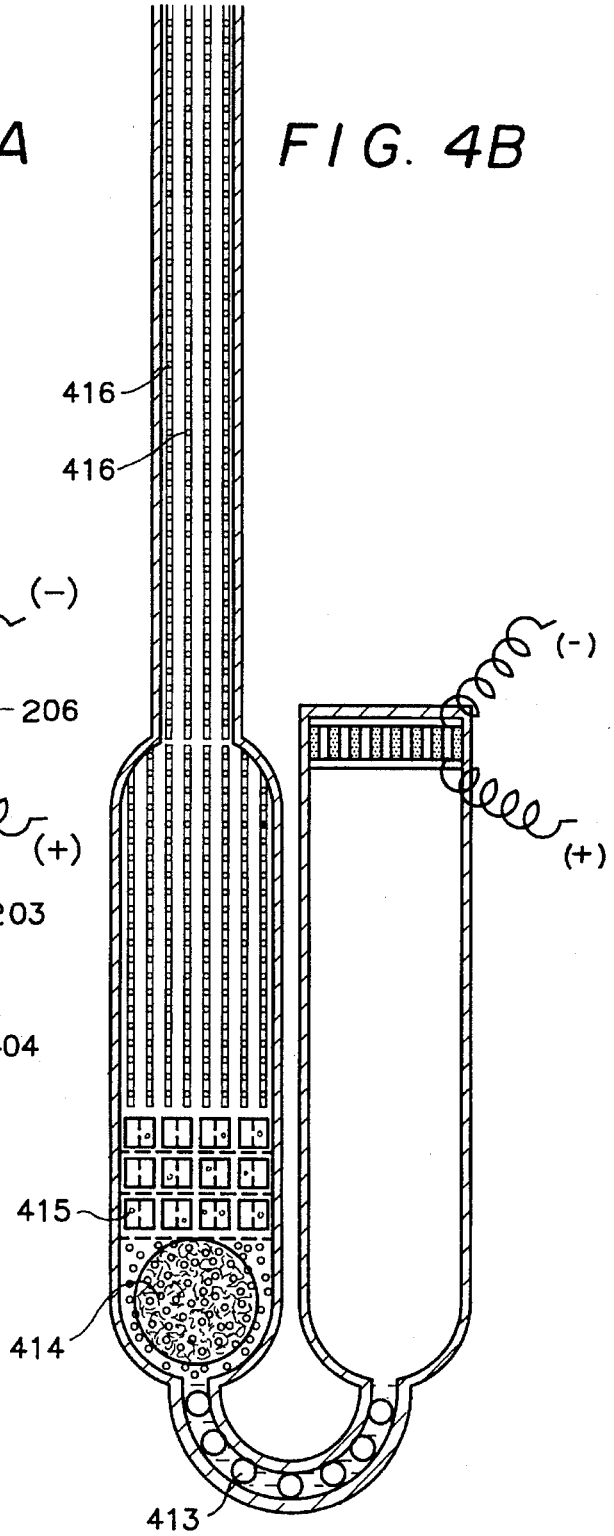

FIGS. 4A and 4B are detailed drawings showing respectively the lower reservoir and related elements initially when the system is not operating, and after applying power to the active cooling and heating means of the upper and lower reservoirs. In FIG. 4A, when the system is turned off, the lower reservoir 203 is partially filled with the volatile liquid 404. The reservoir is also in thermal contact with a heat producing means, such as an electrical resistance or a thermoelectric device 206. In addition to partially filling the lower reservoir 203, the volatile liquid also partially fills the bubble refining area 207 and the neck 405 connecting the reservoir 203 with the bubble refining area 207. The bubble refining area 207 contains one or more elements of preferably non-chemically-reactive materials designed to successively break the vapor bubbles of the volatile liquid into smaller and smaller bubbles prior to rising in the transparent tube 102. These elements include one or more of: a wad of glass wool (408), a plurality of solid objects such as small cubes 410 of stone, glass, and/or metal with drilled holes, and tubes 411 (which may be, for example, of the size of medical needles), all of which elements may be individually encased within one or more perforated screen housings 409. The small cubes are designed to be closely packed in a plurality of stacked rows, preferably with decreasing bore diameter. Transparent tube 402 also comprises in the preferred embodiment a plurality of narrow tubes such as capillary tubes 412 enclosed within the tube housing.

The operation of the lower reservoir when power is applied to the heating and cooling means may be seen in FIG. 4B in connection with FIG. 4A. Initially upon application of heat to the lower reservoir (while maintaining a lower temperature in the upper reservoir), the vapor pressure of the liquid in the lower reservoir increases, causing the level of liquid to descend and the liquid to be forced into the bubble refining area 207 and up the transparent tube 102 into the upper reservoir (not shown). Eventually, substantially all of the liquid is forced out of the lower reservoir so that the bubble refining area 207, the transparent tube 102 and a portion of the upper reservoir (not shown in FIGS. 4A and 4B) become filled with liquid. Thus, substantially two large regions of vapor are formed, one in the lower reservoir, and one in the upper reservoir, wherein the regions are separated by the volatile liquid. If the proper amount of cooling of the upper reservoir and heating of the lower reservoir is maintained, a series of large bubbles 413 form in a bubble generation area in the vicinity of the neck 405 connecting the lower reservoir with the bubble refining area 407. These bubbles are successively broken into smaller bubbles 414, 415 by passage through the glass wool 408, perforated screen housings 409, small bored solid objects 410, and tiny bored tubes 411. Because the vapor has lower density than the surrounding liquid, the vapor bubbles rise in the bubble transfer transparent tube 402 (within the narrow tubes 412) until reaching the upper reservoir (not shown in FIGS. 4A and 4B), whereupon they condense into liquid. At the same time, an equivalent mass quantity of liquid (having a total volume only a tiny fraction of the volume occupied by the vapor bubbles, due to the expansion ratio upon vaporization of the liquid) travels down the transparent tube 102 (within narrow tubes 412) against the rise of the bubbles and eventually flows through the neck 405 and into the bottom of the lower reservoir 203 whereupon it is vaporized in the bubble generation area by the heat applied to the lower reservoir, to continue the cycle.

During this entire bubble forming process in the preferred embodiment, the control circuit 208 monitors and possible displays the temperature in the upper and lower reservoirs and provides the proper power and/or control signals to the upper and lower cooling and heating means to ensure optimal temperature for the formation of the bubbles. Alternatively, in the absence of control circuit 208, suitable thermostatic means may be provided for the individual reservoirs to maintain the desired temperatures.

While the present invention has been described in the context of a statuette device for displaying a visual effect simulating the travel of a fluid up a transparent tube, it should be clear that the principles of the invention may be equally applied in other circumstances where it is desired to cause a continual formation of tiny bubbles for upward travel in a tube. For example, similar display apparatus may be provided simulating the appearance of gasoline being pumped into a vehicle, or of firemen putting out a fire by shooting water from a firehose, etc. Thus, the scope of the invention should not be limited by foregoing discussion, but only by the claims appended herewith.

What is claimed is:

1. A device for simulating the travel of liquid up a tube, said device comprising:

a lower reservoir in thermal contact with heat producing means and substantially filled, under steady state operation, with vapor of a volatile liquid;

a bubble generation section external to said lower reservoir and connected to said lower reservoir for producing bubbles in said volatile liquid upon receiving vapor from said lower reservoir;

a bubble refining section connected to said bubble generation section for decreasing the size of said bubbles;

a bubble transfer tube connected to said bubble refining section for transferring the bubbles from said bubble refining section; and an upper reservoir connected to said bubble transfer tube and in thermal contact with heat removal means, said upper reservoir receiving and condensing bubbles from said bubble transfer tube.

2. The device of claim 1, further comprising control means to control the quantity of heat transferred by at least one of said heat producing means and said heat removal means.

3. The device of claim 2, wherein said control means further comprises thermal sensing means to sense the temperature of at least one of said lower and upper reservoirs.

4. The device of claim 2, wherein said control means is connected between a source of electrical power and at least one of said heat producing means and said heat removal means.

5. The device of claim 1, wherein said heat producing means comprises an electrical resistance.

6. The device of claim 1 wherein said heat producing means comprises a thermoelectric device.

7. The device of claim 1 wherein said heat removal means comprises an electric fan.

8. The device of claim 1 wherein said heat removal means comprises a thermoelectric device.

9. The device of claim 1 wherein said heat removal means includes a mass of thermally conductive wires in thermal contact with air.

10. The device of claim 1, wherein said bubble transfer tube has a plurality of narrow tubes contained therein.

11. The device of claim 1, wherein at least one of said heat producing means and said heat removal means is powered by a solar cell.

12. The device of claim 1, wherein the cross-sectional area of said bubble transfer tube is smaller than the cross-sectional area of each of said upper reservoir and said lower reservoir.

13. The device of claim 1, wherein said bubble refining section comprises a series of refining stages of successively smaller and smaller apertures.

14. The device of claim 1, wherein said bubble refining section comprises at least one of: a wad of glass wool, stones, apertured cubes and tubes.

15. A method for causing a plurality of tiny bubbles to rise in a tube, comprising:

applying heat to a lower reservoir substantially filled with vapor of a volatile liquid; causing the formation of lame bubbles in a bubble generation section from vapor derived from said lower reservoir;

passing said large bubbles through a bubble refining section to create tiny bubbles;

passing said tiny bubbles through said tube and thence into an upper reservoir; and condensing said tiny bubbles by removing heat from said upper reservoir.

16. The method of claim 15 for causing a plurality of tiny bubbles to rise in a tube, further comprising control means for monitoring the temperature in at least one of said lower and upper reservoirs and controlling the quantity of heat transferred in said steps of applying heat and removing heat.

17. The device of claim 16, wherein said control means is connected between a source of electrical power and at least one of said heat producing means and said heat removal means.

18. A device for simulating the travel of liquid up a tube; said device comprising;

a lower reservoir in thermal contact with heat producing means and substantially filled, under steady state operation, with vapor of a volatile liquid;

a bubble generation section external to said lower reservoir and connected to said lower reservoir for producing bubbles in said volatile liquid upon receiving vapor from said lower reservoir;

a bubble refining section connected to said bubble generation section for decreasing the size of said bubbles;

a bubble transfer tube connected to said bubble refining section for transferring the bubbles from said bubble refining section;

an upper reservoir connected to said bubble transfer tube and in thermal contact with heat removal means, said upper reservoir receiving and condensing bubbles from said bubble transfer tube; and control means for controlling at least one of the quantity of heat transferred to said lower reservoir by said heat producing means and the amount of heat transferred from said upper reservoir by said heat removal means.

19. The device of claim 18, wherein said control means further comprises thermal sensing means to sense the temperature of at least one of said lower and upper reservoirs.

20. The device of claim 18, wherein said heat producing means comprises an electrical resistance.

21. The device of claim 18, wherein said heat producing means comprises a thermoelectric device.

22. The device of claim 18, wherein said heat removal means comprises an electric fan.

23. The device of claim 18, wherein said heat removal means comprises a thermoelectric device.

24. The device of claim 18, wherein said heat removal means includes a mass of thermally conductive wires in thermal contact with air.

25. The device of claim 18, wherein said bubble transfer tube has a plurality of narrow tubes contained therein.

26. The device of claim 18, wherein at least one of said heat producing means, said heat removal means, and said control means is powered by a solar cell.

27. The device of claim 18, wherein the cross-sectional area of said bubble transfer tube is smaller than the cross-sectional are of each of said upper reservoir and said lower reservoir.

28. The device of claim 18, wherein said control means is connected between a source of electrical power and at least one of said heat producing means and said heat removal means.

29. The device of claim 18, wherein said bubble refining section comprises a series of refining stages of successively smaller and smaller apertures.

30. The device of claim 18, wherein said bubble refining section comprises at least one of: a wad of glass wool, stones, apertured cubes and tubes.

31. A device for simulating the travel of liquid up a tube, said device comprising:

a lower reservoir in thermal contact with heat producing means and substantially filled, under steady state operation, with vapor of a volatile liquid;

a bubble generation section external to said lower reservoir and connected to said lower reservoir for producing bubbles in said volatile liquid upon receiving vapor from said lower reservoir;

a bubble refining section connected to said bubble generation section for decreasing the size of said bubbles;

a bubble transfer tube connected to said bubble refining section for transferring the bubbles from said bubble refining section; and an upper reservoir connected to said bubble transfer tube and in thermal contact with heat removal means, said upper reservoir receiving and condensing bubbles from said bubble transfer tube wherein said heat removal means includes a porous mass of heat dissipation material presenting a large surface area in contact with ambient air.

32. The device of claim 31, wherein said heat producing means comprises an electrical resistance.

33. The device of claim 31, wherein said heat producing means comprises a thermoelectric device.

34. The device of claim 31, wherein said heat removal means includes an electric fan for forcing air through said mass of porous heat dissipation material.

35. The device of claim 31, wherein at least one of said heat producing means and said heat removal means is powered by a solar cell.

36. The device of claim 31, wherein the cross-sectional area of said bubble transfer tube is smaller than the cross-sectional area of each of said upper reservoir and said lower reservoir.

37. The device of claim 31, wherein said bubble refining section comprises a series of refining stages of successively smaller and smaller apertures.

38. The device of claim 31, wherein said bubble refining section comprises at least one of: a wad of glass wool, stones, apertured cubes and tubes.

39. A device for simulating the travel of liquid up a tube, said device comprising: a lower reservoir in thermal contact with heat producing means;

a bubble generation area external to said lower reservoir and connected to said lower reservoir for producing bubbles in a volatile fluid upon application of heat from said heat producing means;

a bubble refining area connected to said bubble generation area for refining the size of said bubbles;

a bubble transfer tube for transferring the bubbles from said bubble refining area;

an upper reservoir connected to said bubble transfer tube and in thermal contact with heat removal means, said upper reservoir receiving and condensing bubbles from said bubble transfer tube; and wherein at least a portion of the wall of said lower reservoir comprises thermally insulating material and at least a portion of the wall of said upper reservoir comprises thermally conducting material.

40. A device for simulating the travel of liquid up a tube, said device comprising:

a lower reservoir in thermal contact with heat producing means;

a bubble generation area connected to said lower reservoir for producing bubbles in a volatile fluid upon application of heat from said heat producing means;

a bubble refining area connected to said bubble generation area for refining the size of said bubbles;

a bubble transfer tube for transferring the bubbles from said bubble refining area; an upper reservoir connected to said bubble transfer tube and in thermal contact with heat removal means, said upper reservoir receiving and condensing bubbles from said bubble transfer tube; control means for controlling at least one of a quantity of heat transferred to said lower reservoir by said heat removal means; and wherein at least a portion of the wall of said lower reservoir comprises thermally insulating material and at least a portion of the wall of said upper reservoir comprises thermally conducting material.

41. A device for simulating the travel of liquid up a tube, said device comprising: a lower reservoir in thermal contact with heat producing means;

a bubble generation area connected to said lower reservoir for producing bubbles in a volatile fluid upon application of heat from said heat producing means;

a bubble refining area for refining the size of said bubbles;

a bubble transfer tube connected to said bubble refining area for transferring the bubbles from said bubble refining area;

an upper reservoir connected to said bubble transfer tube and in thermal contact with heat removal means, said upper reservoir receiving and condensing bubbles from said bubble transfer tube wherein said heat removal means includes a porous mass of heat dissipation material presenting a large surface area in contact with ambient air; and wherein at least a portion of the wall of said lower reservoir comprises thermally insulating material and at least a portion of the wall of said upper reservoir in contact with said porous mass of heat dissipation material comprises thermally conducting material.

42. A method for causing a plurality of tiny bubbles to rise in a tube, comprising:

heating a lower reservoir filled with a volatile liquid and its vapor to thereby cause said liquid to move from said reservoir into a bubble generating section, a bubble refining section, a bubble transfer tube, and an upper reservoir;

causing the formation of large bubbles in said bubble generating section by the continued heating of said lower reservoir, said bubble generating section being external to said lower reservoir but in communication therewith;

passing said large bubbles from said bubble generating section through said bubble refining section, filled with said volatile liquid, by the continued heating of said lower reservoir so that tiny bubbles are created in said bubble refining section, said bubble refining section being in communication with said bubble generating section;

passing said tiny bubbles through said bubble transfer tube, filled with said volatile liquid, and into said upper reservoir, partially filled with said volatile liquid, by the continued heating of said lower reservoir, said bubble transfer tube being in communication with said bubble refining section and said upper reservoir being external to said bubble transfer tube but in communication therewith; and removing heat from said upper reservoir to condense said tiny bubbles therein.

43. The method of claim 42, further comprising using a control means for monitoring the temperature in at least one of said lower and upper reservoirs and controlling the quantity of heat in said steps of heating said lower reservoir and removing heat from said upper reservoir.

44. The method of claim 43, wherein said control means is connected between a source of electrical power and at least one of said heat producing means and said heat removal means.

* * * * *